US008274442B2

(12) United States Patent
Tu

(10) Patent No.: US 8,274,442 B2
(45) Date of Patent: Sep. 25, 2012

(54) SLOT ANTENNA

(75) Inventor: Hsin-Lung Tu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 329 days.

(21) Appl. No.: 12/826,624

(22) Filed: Jun. 29, 2010

(65) Prior Publication Data

US 2011/0298681 A1 Dec. 8, 2011

(51) Int. Cl.
*H01Q 13/10* (2006.01)

(52) U.S. Cl. ..... 343/770

(58) Field of Classification Search ..... 343/770, 343/702, 767, 769, 846, 700 MS
See application file for complete search history.

(56) References Cited

U.S. PATENT DOCUMENTS

| | | | | |
|---|---|---|---|---|
| 5,828,340 | A * | 10/1998 | Johnson | 343/700 MS |
| 7,042,401 | B2 * | 5/2006 | Park et al. | 343/700 MS |
| 7,158,089 | B2 * | 1/2007 | Mohammadian et al. | 343/795 |
| 7,176,837 | B2 * | 2/2007 | Sonoda et al. | 343/700 MS |
| 7,239,283 | B2 * | 7/2007 | Chua | 343/746 |
| 7,268,741 | B2 * | 9/2007 | Sarabandi et al. | 343/866 |
| 2003/0043084 | A1 | 3/2003 | Egashira | |
| 2004/0017315 | A1 * | 1/2004 | Fang et al. | 343/700 MS |
| 2005/0248487 | A1 * | 11/2005 | Okado | 343/700 MS |

* cited by examiner

*Primary Examiner* — Huedung Mancuso
(74) *Attorney, Agent, or Firm* — Altis Law Group, Inc.

(57) ABSTRACT

A slot antenna located on a substrate with a first surface and a second surface opposite to the first surface includes a feeding portion and a radiating portion. The feeding portion is located on the first surface of the substrate to feed electromagnetic signals. The radiating portion is located on the second surface of the substrate and defines a sector-shaped slot, a first rectangle-shaped slot, a second rectangle-shaped slot, and a third rectangle-shaped slot, wherein the sector-shaped slot is defined by a first semidiameter, a second semidiameter, and an arc connected one by one.

8 Claims, 10 Drawing Sheets

SLOT ANTENNA

BACKGROUND

1. Technical Field

Embodiments of the present disclosure relate to antennas, and more particularly to a slot antenna.

2. Description of Related Art

In the field of wireless communication, the World Interoperability for Microwave Access (WiMAX) standard covers different frequency bands, such as 2.3 GHz~2.4 GHz, 2.496 GHz~2.690 GHz, 3.4 GHz~3.6 GHz and 3.6 GHz~3.8 GHz, while the WIFI standard covers 2.412 GHz~2.472 GHz and 5.170 GHz~5.825 GHz. Currently, a slot antenna can radiate only one frequency band of the WiMAX standard or the WIFI standard. Various slot antennas may be required to comply with different frequency bands, which increases costs of the antenna configurations. Therefore, a slot antenna complying with different frequency bands is called for.

BRIEF DESCRIPTION OF THE DRAWINGS

The details of the disclosure, both as to its structure and operation, can best be understood by referring to the accompanying drawings, in which like reference numbers and designations refer to like elements.

DETAILED DESCRIPTION

The details of the disclosure, both as to its structure and operation, can best be understood by referring to the accompanying drawings, in which like reference numbers and designations refer to like elements.

Figure 1:
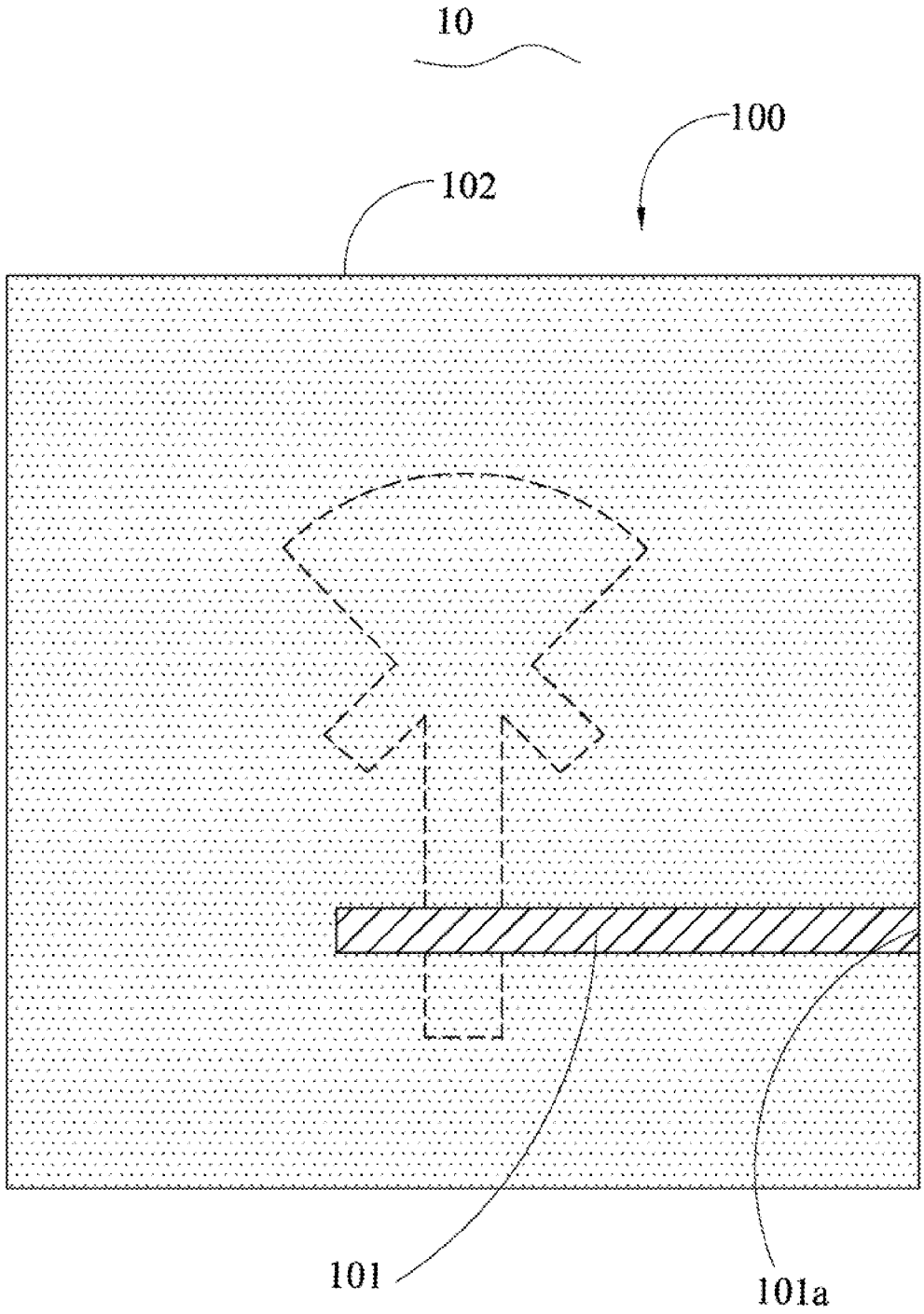
FIG. 1 and FIG. 2 are a plan view and an inverted view of one embodiment of a slot antenna of the present disclosure, respectively.
Figure 2:
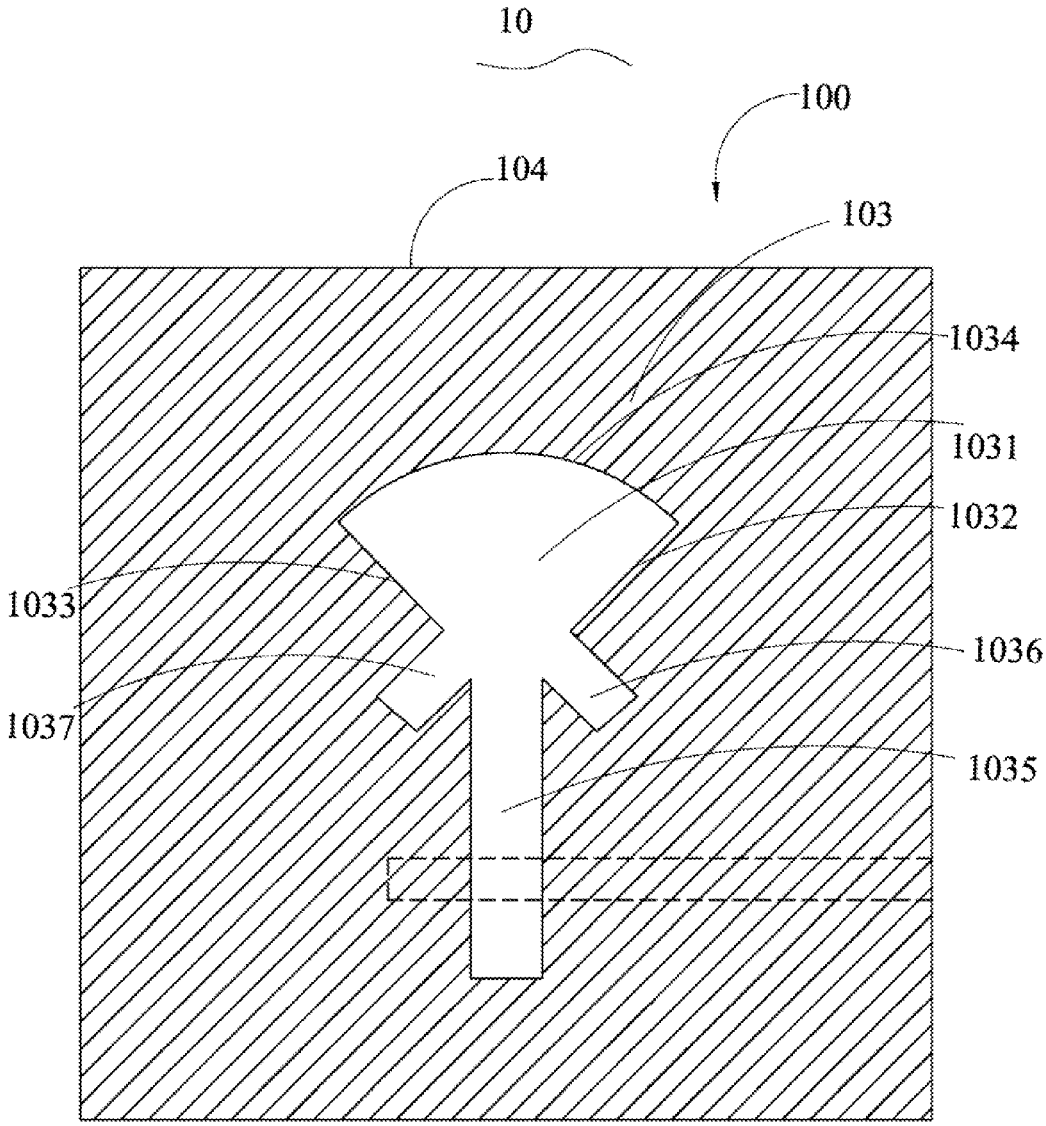

FIG. 1 and FIG. 2 are a plan view and an inverted view of one embodiment of a slot antenna 10 of the present disclosure, respectively. As shown, the slot antenna 10 is located on a substrate 100 having a first surface 102 and a second surface 104 opposite to the first surface 102, and comprising a feeding portion 101 and a radiating portion 103.

The feeding portion 101 is located on the first surface 102, and comprises a feeding point 101*a* to feed electromagnetic signals.

The radiating portion 103 is located and configured on the second surface 104 to radiate electromagnetic signals, and comprises a sector-shaped slot 1031, a first rectangle-shaped slot 1035, a second rectangle-shaped slot 1036, and a third rectangle-shaped slot 1037. In one embodiment, the sector-shaped slot 1031 is defined by a first semidiameter 1032, a second semidiameter 1033, and an arc 1034 connected one by one. In one embodiment, the radiating portion 103 is grounded. The feeding portion 101 interacts with the radiating portion 103 so as to radiate the electromagnetic signals.

In one embodiment, the first rectangle-shaped slot 1035, the second rectangle-shaped slot 1036, and the third rectangle-shaped slot 1037 are commonly extended away from a center of the sector-shaped slot 1031. In one embodiment, the second rectangle-shaped slot 1036 and the third rectangle-shaped slot 1037 are substantially symmetrical based on a symmetry axis of the sector-shaped slot 1031, and the symmetry axis of the sector-shaped slot 1031 and a symmetry axis of the first rectangle-shaped slot 1035 are along the same line. In one embodiment, a projection of the feeding portion 101 on the second surface 104 of the substrate 100 overlaps with the first rectangle-shaped slot 1035, and is perpendicular to the symmetry axis of the sector-shaped slot 1031. In one embodiment, the second rectangle-shaped slot 1036 and the third rectangle-shaped slot 1037 are in parallel with the first semidiameter 1032 and the second semidiameter 1033, respectively.

Figure 3:
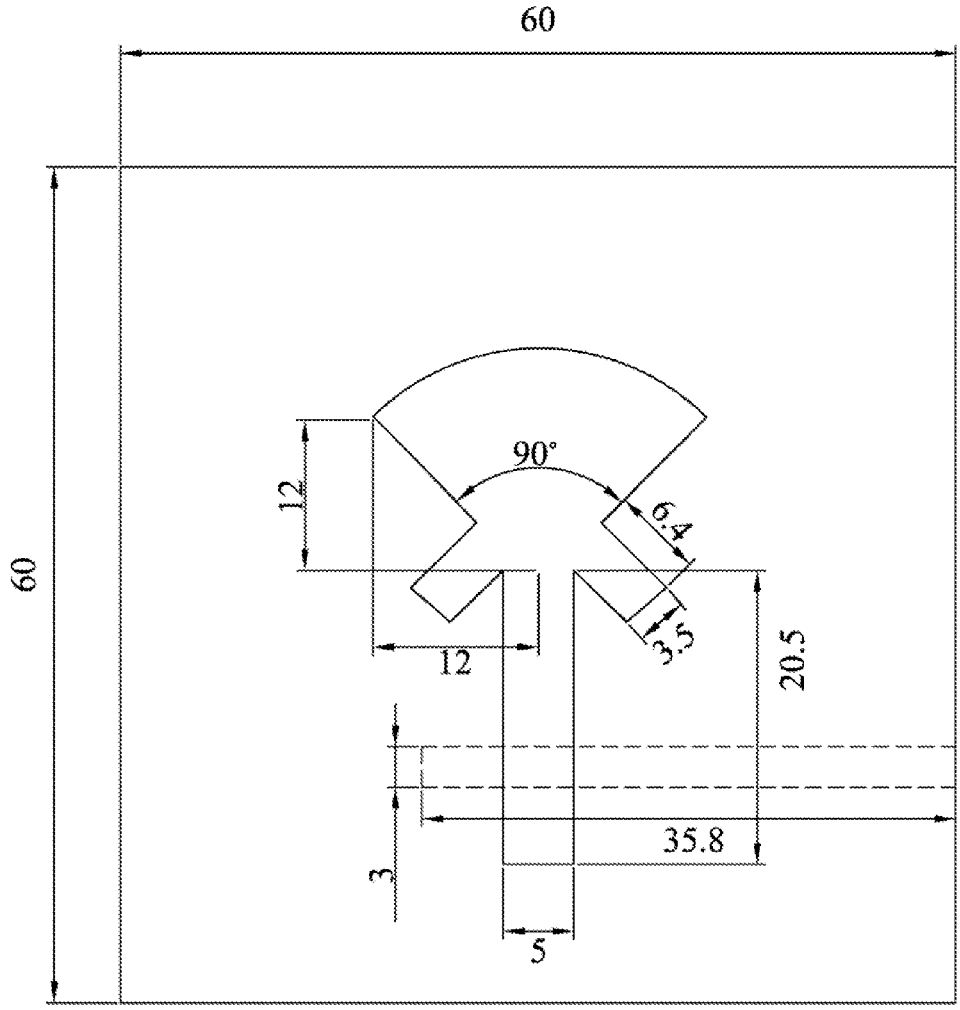
FIG. 3 illustrates exemplary dimensions of the slot antenna of FIG. 1 and FIG. 2.

FIG. 3 illustrates exemplary dimensions of the slot antenna 10 of FIG. 1 and FIG. 2. In one embodiment, assuming a wavelength of a first frequency band radiated by the slot antenna 10 is $\lambda_1$, a total perimeter of the sector-shaped slot 1031 and the first rectangle-shaped slot 1035 is about $2*\lambda_1$. Assuming a wavelength of a second frequency band radiated by the slot antenna 10 is $\lambda_2$, a length of the second (third) rectangle-shaped slot 1036 (1037) is about $(1/4)*\lambda_2$. In one embodiment, a frequency of the second frequency band is higher than that of the first frequency band.

In one embodiment, the substrate 100 is a type FR-4 circuit board, and both a length and a width of the substrate 100 are about 60 mm. A length and a width of the feeding portion 101 equal 35.8 mm and 3 mm, respectively. In one embodiment, the radius of the sector-shaped slot 1031 is about $12\sqrt{2}$ mm, and a central angle of the sector-shaped slot 1031 is about 90°. In one embodiment, a length and a width of the first rectangle-shaped slot 1035 are about equal 20.5 mm and 5 mm, respectively. A length and a width of the second rectangle-shaped slot 1036 (or the third rectangle-shaped slot 1037) are about equal to 6.4 mm and 3.5 mm, respectively. In other embodiments, if the substrate 100 is a circuit board of another type, the substrate 100 and the radiating portion 103 will have different dimensions according to the above design theory.

Figure 4:
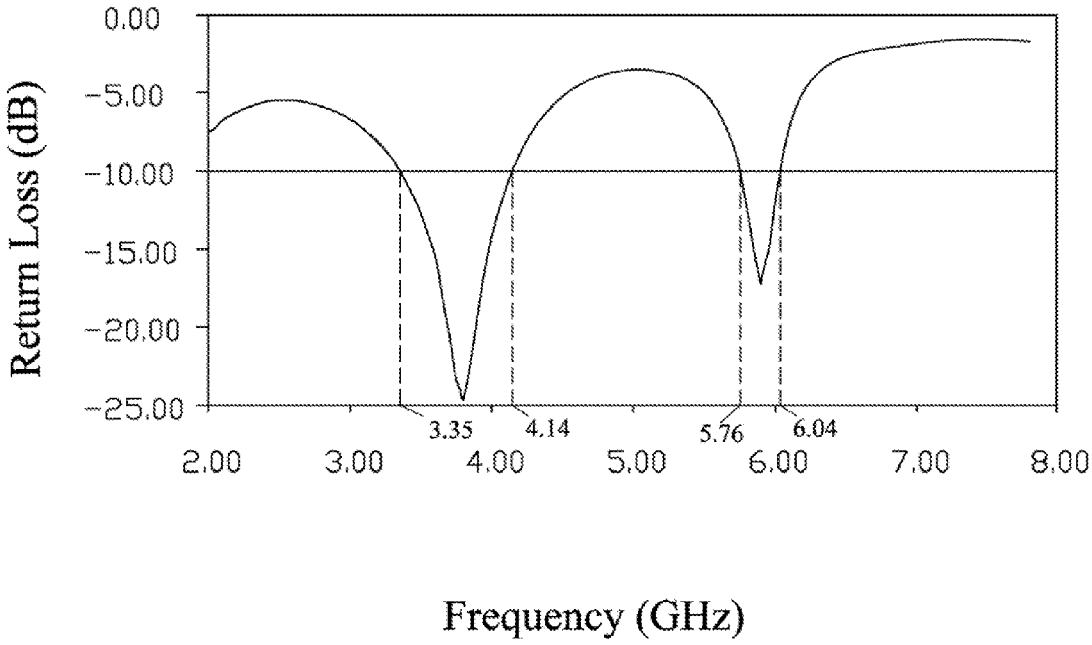
FIG. 4 is a graph showing an exemplary return loss of the slot antenna of FIG. 1 and FIG. 2.

FIG. 4 is a graph showing an exemplary return loss of the slot antenna 10 of FIG. 1 and FIG. 2. As shown, when the dimensions of the slot antenna 10 are shown as in FIG. 3, frequency bands radiated by the slot antenna 10 with a return loss equaling −10 dB include 3.35 GHz~4.14 GHz of the WiMAX standard and 5.76 GHz~6.04 GHz of the WIFI standard. In other embodiments, the slot antenna 10 can radiate more frequency bands of the WiMAX standard and the WIFI standard to meet specific requirements by changing the radius or the central angle of the sector-shaped slot 1031, or changing an angle between the first rectangle-shaped slot 1035 (or the third rectangle-shaped slot 1037) and the second rectangle-shaped slot 1036.

Figure 5:
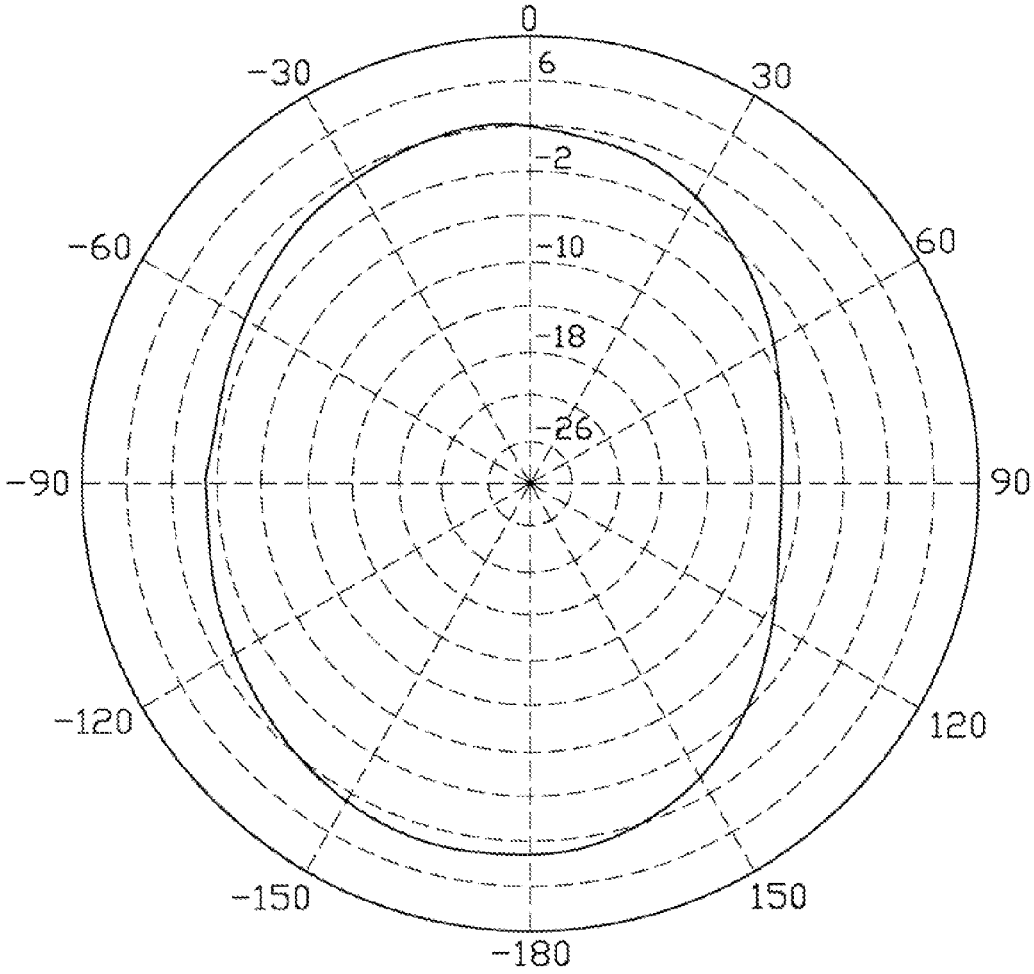
FIGS. 5-7 are test charts showing radiation patterns respectively on X-Y plane, X-Z plane and Y-Z plane when the antenna of FIG. 1 and FIG. 2 operates at frequency of approximately 3.5 GHz.
Figure 6:
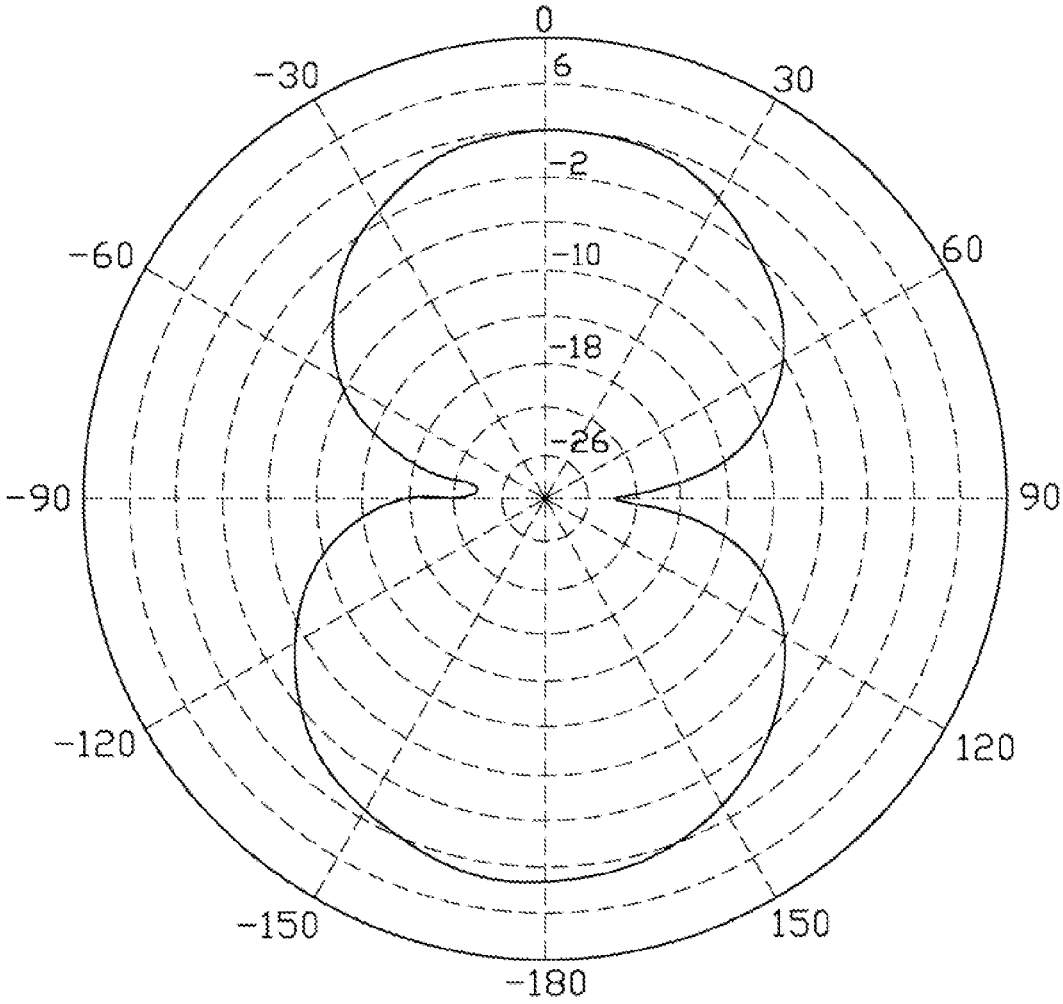
Figure 7:
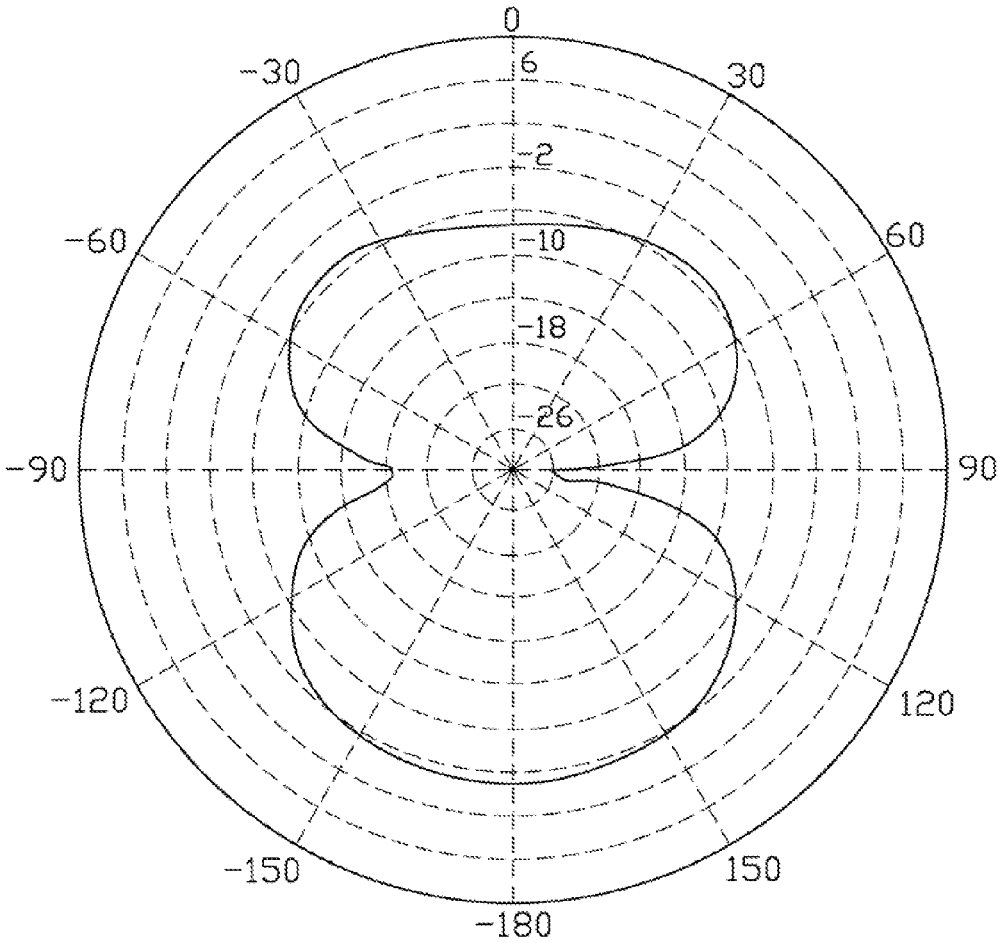

FIGS. 5-7 are test charts showing radiation patterns respectively on X-Z plane, Y-Z plane and X-Y plane when the slot antenna 10 of FIG. 1 and FIG. 2 operates at frequency of approximately 3.5 GHz. As shown, the radiation performance of the slot antenna 10 is perfect and can meet to the requirements of the user.

Figure 8:
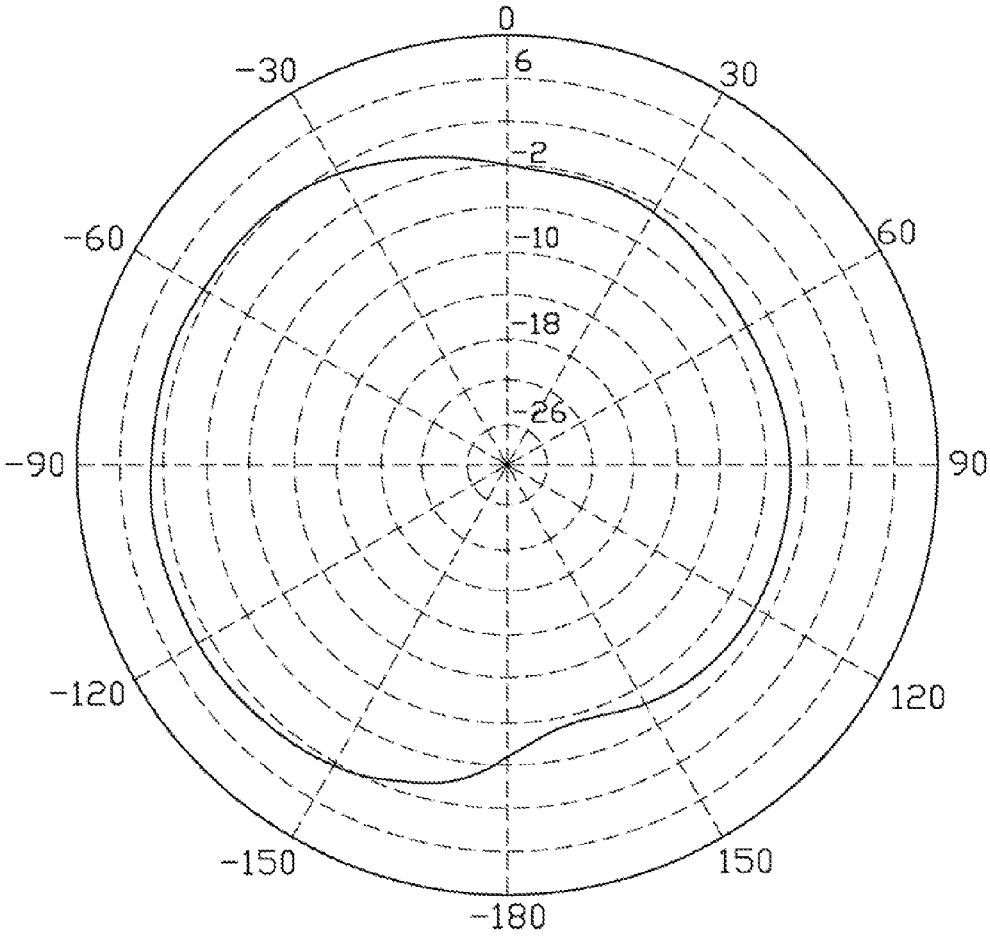
FIGS. 8-10 are test charts showing radiation patterns respectively on X-Y plane, X-Z plane and Y-Z plane when the antenna of FIG. 1 and FIG. 2 operates at frequency of approximately 5.8 GHz.
Figure 9:
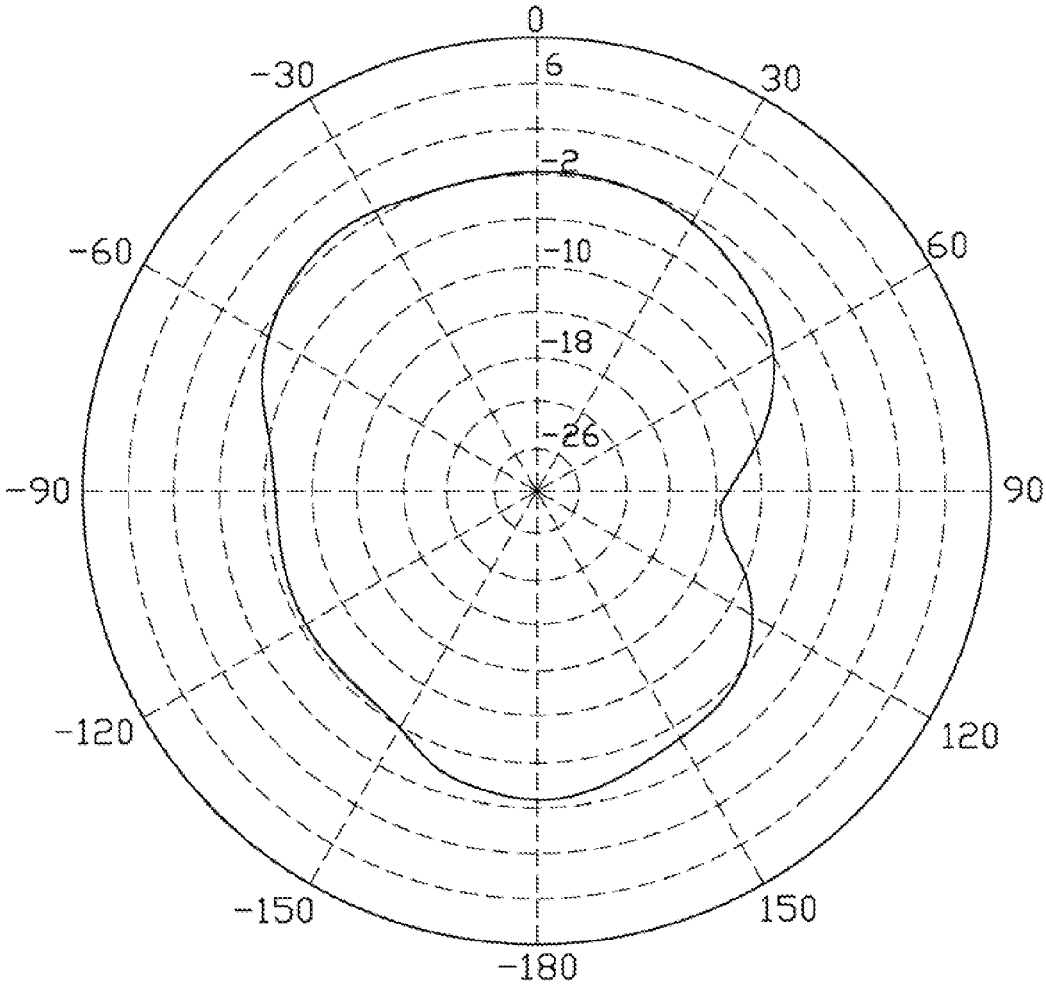
Figure 10:
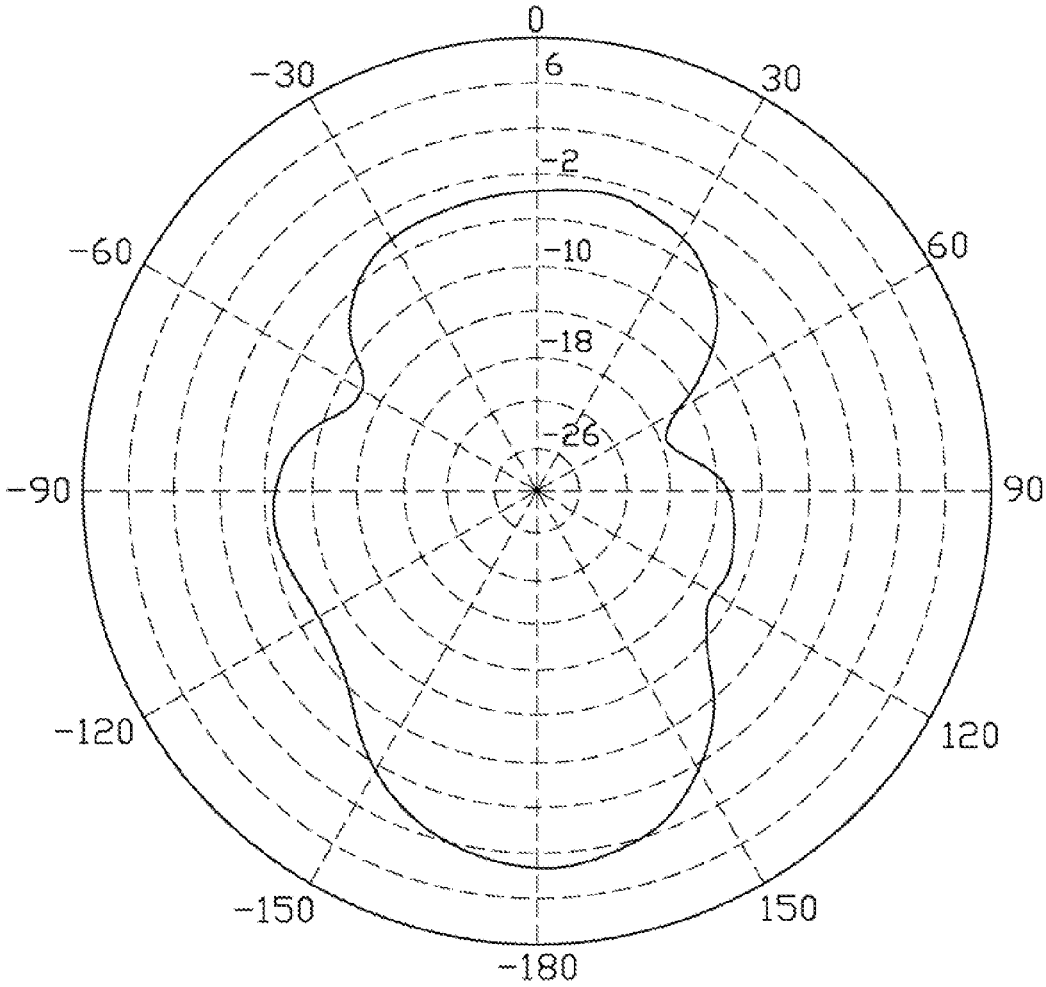

FIGS. 8-10 are test charts showing radiation patterns respectively on X-Z plane, X-Y plane and Y-Z plane when the slot antenna 10 of FIG. 1 and FIG. 2 operates at frequency of approximately 5.8 GHz. As shown, the radiation performance of the slot antenna 10 is perfect and can meet to the requirements of the user.

In one embodiment, the slot antenna 10 can not only radiate more frequency bands, but also reduce a return loss greatly to meet specific requirements by use of the sector-shaped slot 1031, the first rectangle-shaped slot 1035, the second rectangle-shaped slot 1036, and the third rectangle-shaped slot 1037.

While various embodiments and methods of the present disclosure have been described, it should be understood that they have been presented by example only and not by limitation. Thus the breadth and scope of the present disclosure should not be limited by the above-described embodiments, but should be defined only in accordance with the following claims and their equivalents.

What is claimed is:

1. A slot antenna located on a substrate having a first surface and a second surface opposite to the first surface, the slot antenna comprising:

a feeding portion located on the first surface of the substrate, to feed electromagnetic signals; and a radiating portion located on the second surface of the substrate and defining a sector-shaped slot, a first rectangle-shaped slot, a second rectangle-shaped slot, and a third rectangle-shaped slot, wherein the sector-shaped slot is defined by a first semidiameter, a second semidiameter, and an arc connected one by one;

wherein the first rectangle-shaped slot, the second rectangle-shaped slot, and the third rectangle-shaped slot are commonly extended away from a center of the sector-shaped slot, and the second rectangle-shaped slot and the third rectangle-shaped slot are substantially symmetrical based on a symmetry axis of the sector-shaped slot;

wherein a projection of the feeding portion on the second surface of the substrate overlaps with the first rectangle-shaped slot.

2. The slot antenna as claimed in claim 1, wherein the symmetry axis of the sector-shaped slot and a symmetry axis of the first rectangle-shaped slot are along the same line.

3. The slot antenna as claimed in claim 1, wherein the feeding portion is perpendicular to the symmetry axis of the sector-shaped slot.

4. The slot antenna as claimed in claim 1, wherein the second rectangle-shaped slot and the third rectangle-shaped slot are in parallel with the first semidiameter and the second semidiameter, respectively.

5. The slot antenna as claimed in claim 1, wherein a central angle of the sector-shaped slot is about 90°.

6. The slot antenna as claimed in claim 1, wherein a total perimeter of the sector-shaped slot and the first rectangle-shaped slot is about a twice wavelength of a first frequency band radiated by the slot antenna.

7. The slot antenna as claimed in claim 6, wherein a length of the second rectangle-shaped slot is about a quarter of a wavelength of a second frequency band radiated by the slot antenna.

8. The slot antenna as claimed in claim 7, wherein a frequency of the second frequency band is higher than that of the first frequency band.

* * * * *

UNITED STATES PATENT AND TRADEMARK OFFICE

CERTIFICATE OF CORRECTION

PATENT NO. : 8,274,442 B2
APPLICATION NO. : 12/826624
DATED : September 25, 2012
INVENTOR(S) : Hsin-Lung Tu It is certified that error appears in the above-identified patent and that said Letters Patent is hereby corrected as shown below:

On the Title Page, below Item (65) insert

-- (30) Foreign Application Priority Data

Jun. 7, 2010 (CN) .....201010193324.3 --

Signed and Sealed this
Thirteenth Day of May, 2014

Michelle K. Lee

Michelle K. Lee
*Deputy Director of the United States Patent and Trademark Office*